United States Patent [19]

Torita et al.

[11] 4,237,565

[45] Dec. 9, 1980

[54] AUTOMATIC WASHING MACHINE

[75] Inventors: Fumio Torita, Nagoya; Toshihiro Nomura, Okazaki, both of Japan

[73] Assignee: Tokyo Shibaura Denki Kabushiki Kaisha, Kawasaki, Japan

[21] Appl. No.: 46,324

[22] Filed: Jun. 7, 1979

[30] Foreign Application Priority Data

Jun. 12, 1978 [JP] Japan ..... 53-70654

[51] Int. Cl.[3] ..... D06F 33/02

[52] U.S. Cl. ..... 8/158; 68/12 R; 134/113

[58] Field of Search ..... 8/158, 159; 68/12 R, 68/13 R; 134/57 D, 113

[56] References Cited

U.S. PATENT DOCUMENTS

| | | | |
|---|---|---|---|
| 2,430,668 | 11/1947 | Chamberlin | 68/12 R |
| 3,114,253 | 12/1963 | Morey et al. | 68/12 R |
| 3,613,405 | 10/1971 | Shimokusu et al. | 68/12 R |
| 3,888,269 | 6/1975 | Bashark | 134/113 X |

*Primary Examiner*—Philip R. Coe

*Attorney, Agent, or Firm*—Cushman, Darby & Cushman

[57] ABSTRACT

Provided is an automatic washing machine of which the washing, the water draining, and the rinsing operations are automatically controlled by an electric control circuit including an electric timer, arithmetic-operation processor circuit and memory. The machine includes a degree-of-rinse detecting unit which detects the degree of rinse involved and, when this degree has reached a specified value, supplies an output signal to the arithmetic-operation processor circuit to carry out a short overflow rinsing step thus to complete this rinsing operation.

12 Claims, 5 Drawing Figures

AUTOMATIC WASHING MACHINE

This invention relates to an automatic washing machine.

In a conventional automatic washing machine, the washing operation, water-draining/dehydrating operation, etc., are automatically executed and the operating time periods are controlled by a timer device which includes a timer motor, a plurality of cams driven thereby and a plurality of cam switches cooperative with these cams. In this type of automatic washing machine, the operating time for the rinsing operation which follows the washing operation is also controlled by the timer device.

Usually, this rinsing operation includes three or four rinsing steps. Subsequently to the washing step and the water-draining/dehydrating operation step, water is poured into a washing tub and a agitating vane is driven, whereby the first rinsing step is carried out. Thereafter, the second, third and fourth rinsing steps are similarly carried out with the water-draining/dehydrating step following each rinsing step. Thus, the rinsing operation is completed.

According to the material quality, quantity and degree of stain of the washing, however, only two rinsing steps are often enough to obtain a sufficient rinsing effect. In such a case, the third and fourth rinsing steps are unnecessarily carried out. This results in an unnecessarily large power consumption and waste of water and also in the shortening of the life of the motor and other associated parts. Conversely, even after the three or four rinsing steps have been completed, a failure to obtain a sufficient rinsing effect for the washing may occur. In such a case, it becomes necessary to set the timer device again to further perform the rinsing operation. This is very troublesome.

The object of the invention is to provide an automatic washing machine which makes it possible to obtain an efficient rinsing operation.

According to a preferred embodiment of the invention, there is provided an automatic washing machine which comprises a rotatable tub for receiving washing therein, agitating vane provided inside the tub, driving means for selectively driving the tub and agitating vane, control means including a timer circuit for setting at least the period in which the washing step is executed and an information processing circuit for energizing the driving means in accordance with the time information from the timer circuit to selectively drive the tub and agitating vane thereby to carry out the washing and rinsing operations, and degree-of-rinse detecting means for detecting the degree of transparency of the water used during the rinsing operation and, when having detected that said degree of transparency has reached a specified value, supplying an output signal to the control means to carry out a final rinsing step for a specified period of time and complete rinsing operation.

This invention can be more fully understood from the following detailed description when taken in conjunction with the accompanying drawings, in which.

Figure 1:
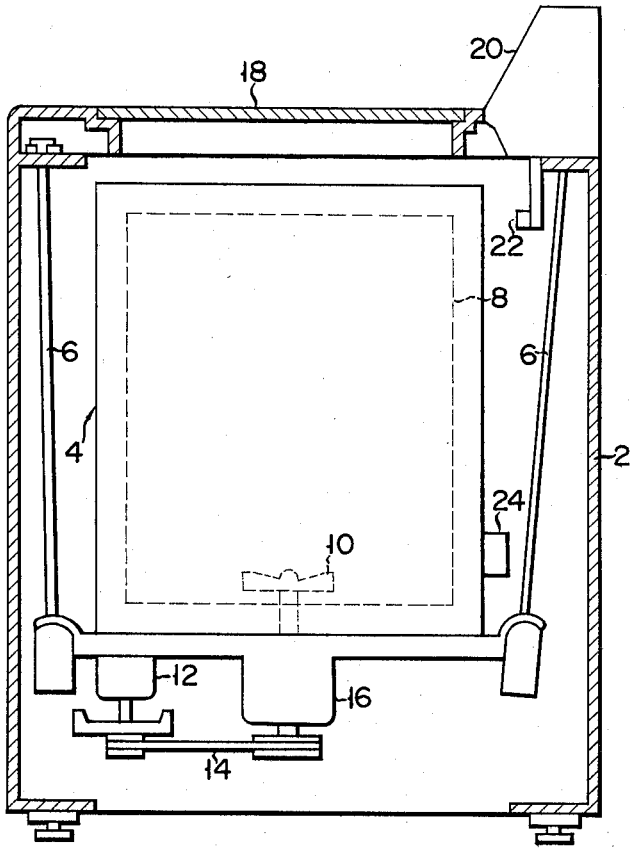
FIG. 1 is a partially sectional view of an automatic washing machine according to an embodiment of the invention.

FIG. 1 is a partially sectional view of an automatic washing machine according to an embodiment of the invention. The washing machine includes an outer case 2, a water receiving tub 4 which is vertically movably supported within the outer case 2 by a support member 6, a washing and dehydrating tub 8 rotatably installed within the water receiving tub 4, and an agitating vane 10 provided within the tub 8. Within the outer case 2 is further disposed a electric motor 12 for selectively driving the tub 8 and agitating vane 10 through a belt transmission mechanism 14 and a power transmission control mechanism 16. Over the tubs 4 and 8 is disposed a covering or lid 18 which permits the charging and discharging of the washing into and from the tub 8. On the outer case 2 is provided an operating box 20 which has stored therein an electronic timer information processor, etc. as later described. An abnormal status detector 22 is provided projecting downwards from the operating box 20 so as to detect the abnormal vibrations of the tub 4 at the time when the tub 8 is in rotation.

Figure 2:
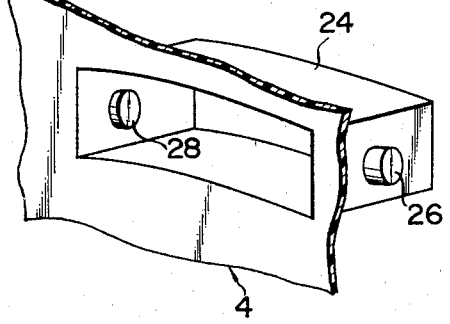
FIG. 2 is a schematic view of a degree-of-rinse detecting unit for detecting the degree-of-transparency of the water used in the rinsing operation of the automatic washing machine illustrated in FIG. 1.

The water-receiving tub 4 is formed with a recess 24 at its side wall. As shown in FIG. 2, a light emission element such as a light emission diode 26 and a light reception element such as a phototransistor 28 are positioned at horizontally opposed side walls of the recess 24, respectively. The light emission diode 26 and phototransistor 28 constitutes a degree-of-transparency detecting unit for detecting the transparency of the water in the water reception tub 4.

Figure 3:
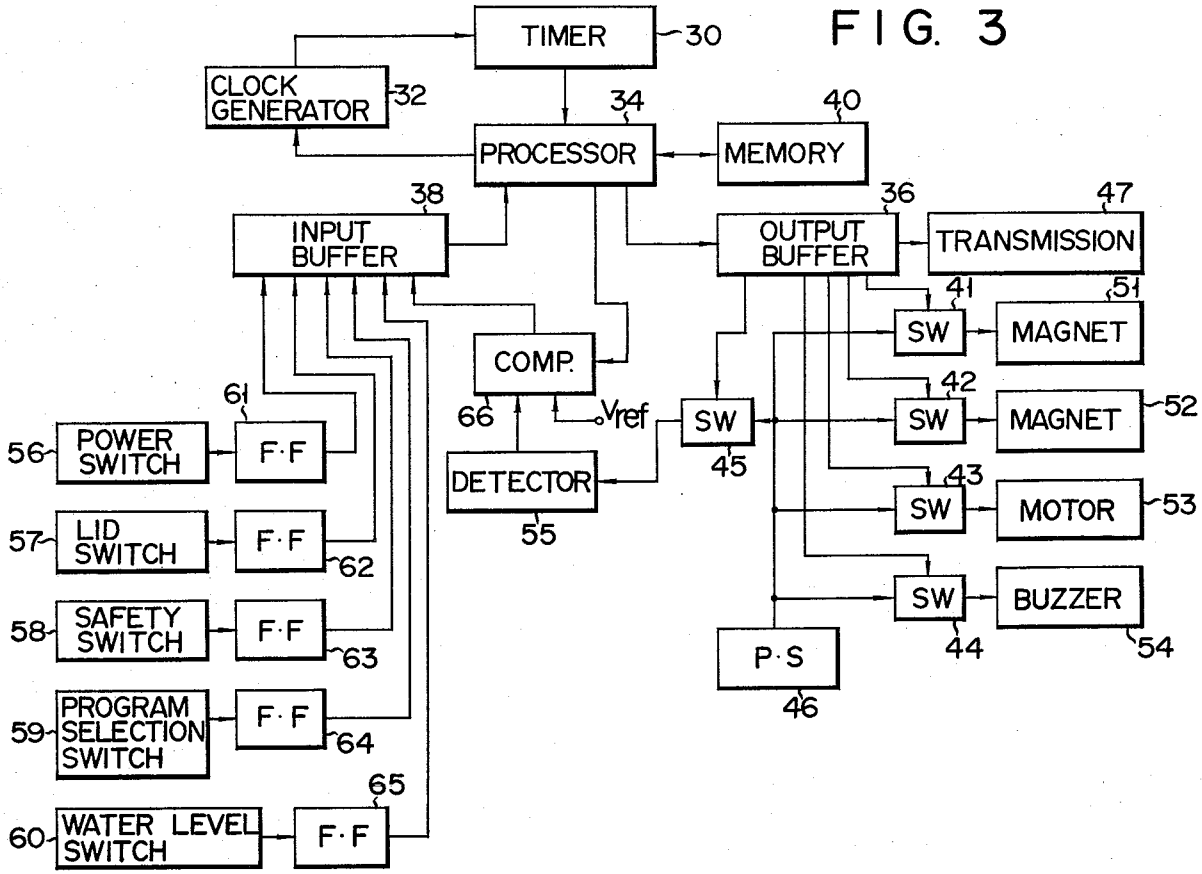
FIG. 3 is a block circuit diagram of an electronic control circuit for controlling the operation of the washing machine illustrated in FIG. 1.

FIG. 3 shows an electronic circuit section which is located in the operating box 20 of the washing machine illustrated in FIG. 1. An electronic timer 30 counts the operating time for washing step, dehydrating step and rinsing step in response to the timing signal from the clock generator 32. An information processor 34 supplies information which corresponds to the time information from the electronic timer 30, parallel status information from an input buffer 38 and program information from a memory 40 in parallel fashion to the output buffer 36. The output terminals of the output buffer 36 are coupled to the control terminals of switches 41 to 45 for controlling the coupling conditions in which a power supply 46 is coupled to electromagnets 51, 52, motor 53, buzzer 54 and detector 55, respectively. Further, another output terminal of the output buffer 36 is coupled to a power transmission section 47 which corresponds to the above-mentioned power transmission mechanism 16.

Further a power switch 56, lid switch 57, safety switch 58, program selection 59 and water-level switch 60 are coupled to the input terminals of an input buffer 38, respectively, through flip-flops 61 to 65. To another input terminal of the input buffer 38 is coupled a comparator 66 for comparing the output signal from the detector 55 and a reference signal Vref. The lid switch 57 is operated in response to the opening and closing operations of the lid 18. The program selection switch 59 is so manually operated as to give a desired combination of the washing, dehydrating and rinsing steps. The water-level switch 60 generates a pulse each time it is opened or closed in accordance with the water level in the water receiving tub 4, thereby to change-over the output state of the flip-flop 65. The detector 55 is comprised of the light emission diode 26 and the phototransistor 28 to generate an output signal having an amplitude which corresponds to the water transparency in the tub 4.

Figure 4:
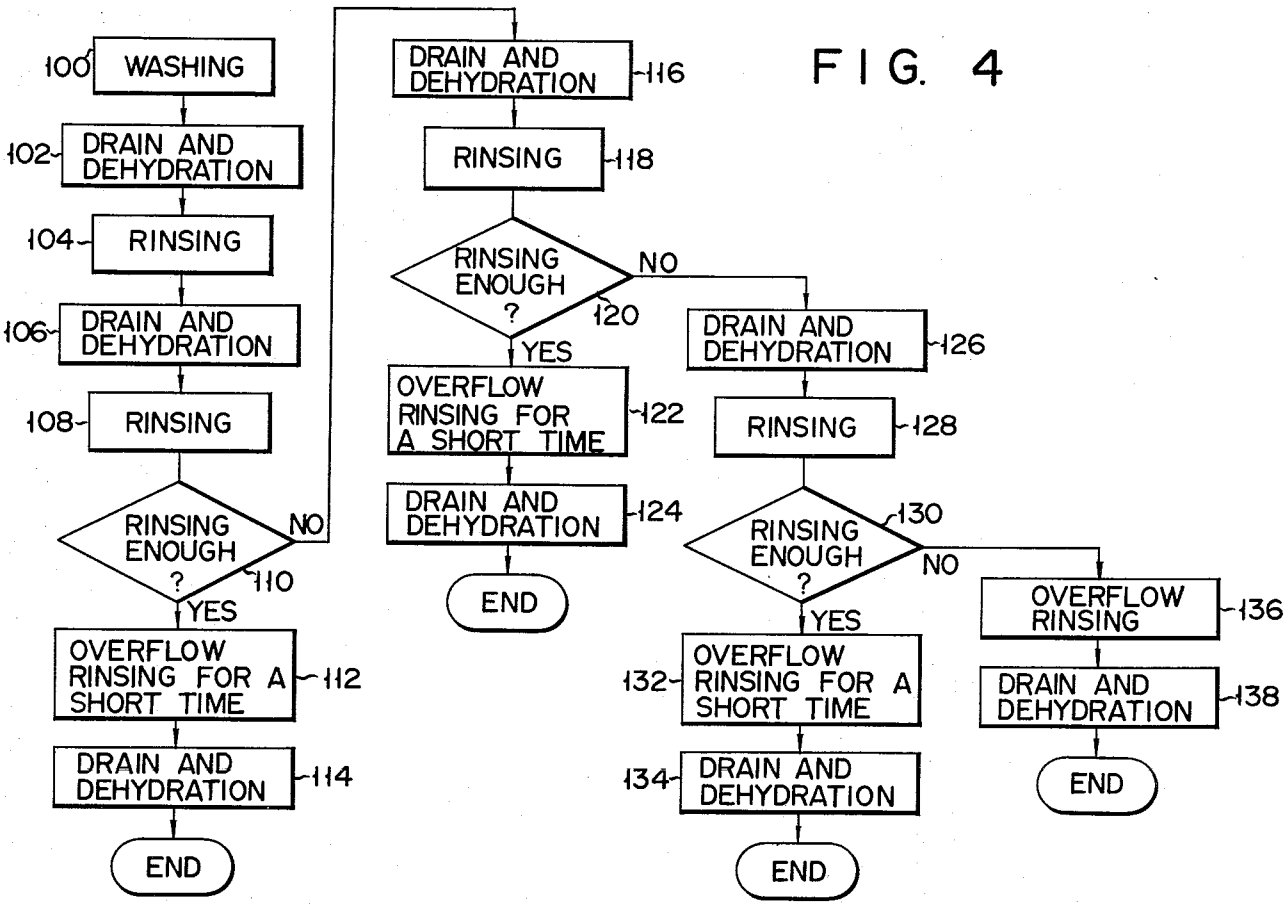
FIGS. 4 and 5 are views for explaining the programs which are stored in a memory of the electronic control circuit illustrated in FIG. 3.
Figure 5:
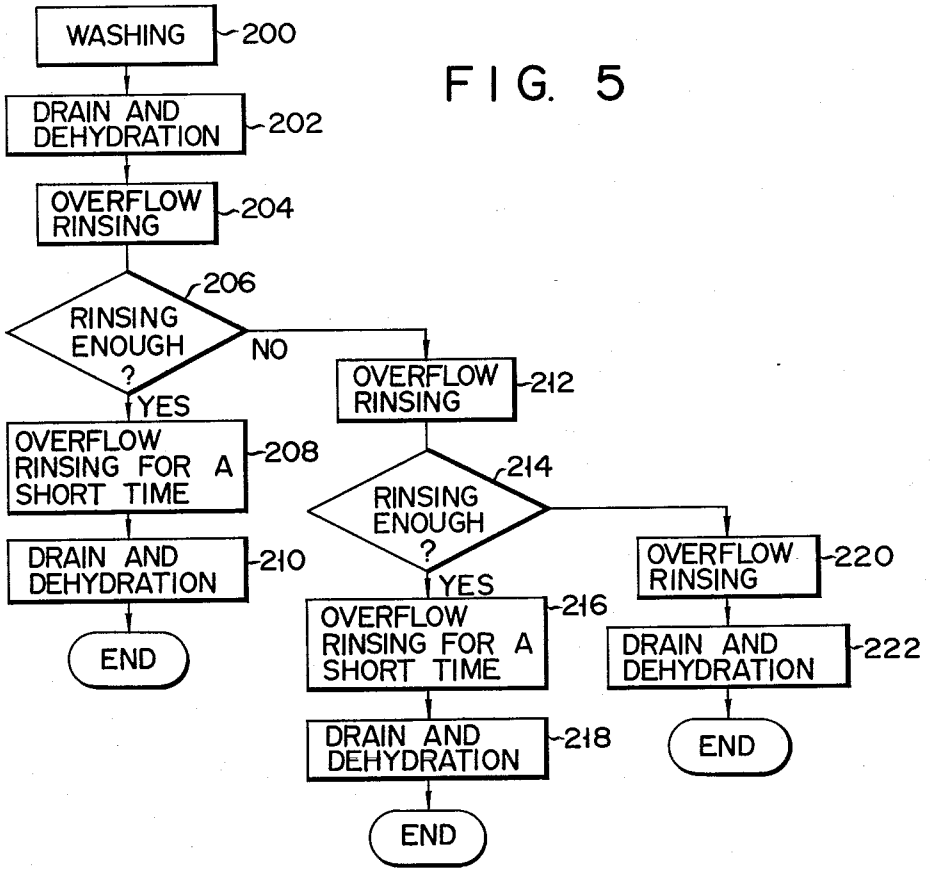

The operation of the washing machine illustrated in FIGS. 1 to 3 will now be explained with reference to those washing programs stored in the memory 40 which are illustrated in FIGS. 4 and 5.

A first reference will be made to the operation mode in which the program selection switch 59 is so set as to cause the washing machine to operate in accordance with the standard washing sequence illustrated in FIG. 4. When the power switch 56 is turned on, the washing step 100 starts. That is, the switch 41 is closed in response to an output signal derived from the processor 34 through the output buffer 36. The electro-magnet 51 is thereby energized to open a water supply valve (not shown). Thus, water is supplied into the tubs 8 and 4. When the water in the tub 4 has reached a specified level, the water level switch 60 is turned on. The electro-magnet 51 is thereby de-energized to stop the water supply. Simultaneously, the processor 34 gives an output signal to the switch 43 and power transmission section 47 through the output buffer 36 to drive the agitating vane 10. The water and washing (not shown) in the tub 8 are thus agitated, whereby the washing starts to be washed.

When the operating time for the washing step 100 set by the electronic timer 30 has elapsed, the motor 12 is de-energized to stop the rotation of the agitating vane 10. Simultaneously, the electro-magnet 52 is energized to open a water drainage valve (not shown). Thus, the water in the tubs 4 and 8 is discharged. When having detected that water drainage is normally effected through the water drainage valve, the processor 34 gives output signals to the switch 43 and power transmission section 47 through the output buffer 36 to cause the tub 8 to rotate. The water drain and dehydration step 102 thereby is carried out for eliminating containing a large amount of cleaner from the washing owing to the centrifugal force. When the operating time which is given by the electronic timer 30 to the first water drain and dehydration step 102 has elapsed, the processor 34 causes a change in the state of the output buffer 36 to open the switch 43 and close the switch 41. The electro-magnet 51 is thereby again energized to supply water into the tubs 4 and 8. Thus, the first rinsing step 104 can be made ready. In the rinsing step 104, the same operation as in the washing step is performed excepting that in this step the water in the tubs 4 and 8 contains residual cleaner.

When the operating time given for the first rinsing step set by the electronic timer 30 has elapsed, the processor 34 causes a change in the contents of the output buffer 36 to control the motor 12 and power transmission section 47. Thus does start the second water-drain and dehydration step 106 which is performed in the same manner as the step 102 is done. When the operating time given for this second water-drain and dehydration step 106 has elapsed, the processor 34 causes a change in the contents of the output buffer 36, whereby the second rinsing operation step 108 similar to the first rinsing step commences.

When a specified operating period of time has elapsed within the operating time given for the second rinsing operation step 108, for example, immediately before the second rinsing operation step 108 is completed, the processor 34 causes a change in the output state of the output buffer 36 to close the switch 45 while this rinsing operation is being performed, thereby to energize the degree-of-transparency detector 55. The light emission diode 26 of this detector 55 is thereby energized to emit light. The phototransistor 28 is thereby energized to generate an output signal having an amplitude corresponding to the transparency of the water in the recess 24. Simultaneously, a comparison instruction signal is supplied from the processor 34 to the comparator 66. Responsive to the comparison instruction signal, the comparator 66 compares the output signal from the detector 55 with the reference signal Vref and, when this output signal has become equal to or larger than the reference signal Vref, an output signal of "1" level is supplied to the input buffer 38. When it has been detected as above in the degree-of-rinse detecting step 110 that a sufficient rinsing operation has been carried out for the washing, the processor 34 causes a change in the output state of the output buffer 36 to close the switches 41 and 42 during the existing rinsing operation. Water supply and drainage valves (not shown) are thereby both opened to effect an "overflow" rinsing step 112. In the "overflow" rinsing step 112, water in the tubs 4 and 8 is drained while a larger amount of water is supplied into the tub 8 so that water in the tube 8 is overflown. The "overflow" rinsing step 112 is executed for a predetermined short period of time irrespective of the time information from the electronic timer 30. After the completion of the "overflow" rinsing operation step 112, the third water-drain and dehydration step 114 is executed and after its completion the switch 44 is closed in response to the output signal from the output buffer 36. Thus, the buzzer 54 gives a warning to inform that the washing sequence involved has been completed.

On the other hand, when it has been detected by the degree-of-rinse detecting step 110 that the rinsing effect is insufficient, the comparator 66 supplies an output signal of "0" level to the input buffer 38. The processor 34 which has sensed the output level of the input buffer 38 subsequently causes the third water drain and dehydration step 116 and rinsing step 118 to be carried out in the same manner as in the steps 106 and 108. In a specified period of time after the commencement of the rinsing step 118, the second degree-of-rinse detecting step 120 similar to the preceding degree-of-rinse detecting step 110 is executed. When it has been detected by the step 120 that a sufficient rinsing effect has been obtained, the "overflow" rinsing step 122 and the fourth water and dehydration step 124 are subsequently carried out in the same manner as in the steps 112 and 114. Then, the buzzer 54 gives a warning to inform that the washing sequence involved has been completed.

When it has been also detected by the second degree-of-rinse detecting step 120 that a further rinsing operation is necessary, the fourth water drain and dehydration step 126 and fourth rinsing step 128 are subsequently executed in the same manner as in the steps 106 and 108. In a specified period of time after the commencement of this rinsing step 128 the third degree-of-rinse detecting step 130 similar to the step 110 is executed. When it has been detected by the step 130 that a sufficient rinsing effect has been obtained, the "overflow" rinsing step 132 and the fifth water-drain and dehydration step 134 are subsequently executed in the same manner as in the steps 112 and 114. Then, a warning is given by the buzzer 54, thereby informing that the washing sequence involved is completed.

When it has been detected by the third degree-of-rinse detecting step 130 that the washing involved has not yet sufficiently been rinsed, the "overflow" rinsing operation step 136 is executed for a longer period of time than in the step 132 and subsequently the fifth water drain and dehydration operation step 138 is executed to energize the buzzer 54, whereby the washing sequence is completed. In the washing sequence illustrated in FIG. 4, the steps 104 and 138 constitute the rinsing operation.

Secondly, reference will be made to the operation mode in which the program switch 59 is so set as to cause the washing machine to operate in accordance with a shorter washing sequence illustrated in FIG. 5.

When the power switch 56 is turned on, the washing step 200 is allowed to commence in the same manner as in the step 100 in the washing sequence illustrated in FIG. 4. After completion of the washing step 200, the water drain and dehydration operation step 202 is executed in the same manner as in the water drain and dehydration step 102. After completion of the step 202, the processor 34 sets the contents of the output buffer 36 to an output state which corresponds to the output state of the input buffer 38, time information from the timer 30 and program information of the memory 40. In accordance with this output state information of the output buffer 36, the switches 41, 42 and 43 are closed and simultaneously the power transmission section 47 is controlled. The water supply and drainage valves (not shown) are thereby opened, whereby the "overflow" rinsing step 204 is executed. For example, immediately before the completion of the step 204 during the operation time thereof, the switch 45 is closed to energize the detector 55 and also a comparison instruction signal is supplied from the processor 34 to the comparator 66, whereby the degree-of-rinse detecting step 206 is executed. When it has been detected by this step 206 that a sufficient rinsing effect for the washing involved has been obtained, a short "overflow" rinsing step 208 which has been preset subsequently to the "overflow" rinsing step 204 is executed and thereafter the water drain and dehydration step 210 is executed. Thereafter, an alarm is given by the buzzer 54 in the same manner as was above explained with reference to FIG. 4 to inform that the washing sequence is completed.

On the other hand, when it has been detected by the step 206 that the rinse degree of the water in the tub 4 is low, that is, that the rinsing effect is insufficient, the second "overflow" rinsing step 212 similar to the step 204 is subsequently executed. Immediately before the completion of the "overflow" rinsing step 212, the degree-of-rinse detecting step 214 is executed in the same manner as in the step 206. When it has been detected by the step 214 that a sufficient rinsing effect has been obtained, short "overflow" rinsing operation step 216 preset subsequently to the step 212 is executed. Thereafter, the water drain and dehydration step 218 is executed. Thereafter, an alarm is given by the buzzer 54 to inform that the washing sequence involved is completed.

When it has been detected by the step 214 that the water in the tub 4 indicates a low degree of transparency, that is, that the rinsing effect is insufficient, the "overflow" rinsing step 220 set to a longer operating period of time than in the step 216 is executed subsequent to the step 212 and thereafter the water drain and dehydration step 222 is executed. Thus, an alarm is given by the buzzer 54 to inform that the washing sequence involved is completed. In the washing sequence illustrated in FIG. 5, the steps 204 and 222 constitute the rinsing operation.

The invention has above been explained by reference to the foregoing embodiment but is not limited thereto. For example, in the washing sequence illustrated in FIG. 4, the water drain and dehydration step 116 and rinsing step 118 can be replaced by a single "overflow" rinsing operation step.

Further, in the above-mentioned embodiment the input and output buffers are each illustrated in unity for simplification of the drawing but can each be constituted by buffer sections of the number corresponding to the number of inputs or outputs.

What we claim is:

1. An automatic washing machine comprising:

a rotatable tub structure for receiving washing therein, an agitating vane provided within said tub structure, driving means for selectively driving said tub structure and said agitating vane, control means including a timer circuit for providing time information and an information processor circuit for energizing said driving means in accordance with said time information from said timer circuit to selectively drive said agitating vane and said tub structure to carry out a washing and rinsing operation, and a degree-of-rinse detecting means for detecting the degree of transparency of water used during a rinsing operation at predetermined points in said rinsing operation when rinsing has been executed for a predetermined period of time;

wherein said control means causes a first final overflow rinsing step to be executed for a specified period of time to terminate said rinsing operation in response to an output signal from said degree-of-rinse detecting means indicating that the degree of transparency of said rinse water is at least equal to a predetermined value; and wherein said control means causes a rinsing step to be executed in response to an output signal from said degree-of-rinse detecting means indicating that the degree of transparent of said rinse water is not at least equal to said predetermined value; and thereafter, when said rinsing step has been executed for a specified period of time, causes a second final overflow rinsing step to be executed for a specified period of time to terminate said rinsing operation in response to an output signal from said degree-of-rinse detection means indicating that the degree of transparency of said rinse water is at least equal to said predetermined value, to complete said rinsing operation.

2. The automatic washing machine of claim 1, wherein said rinsing step includes a water draining substep and a rinsing substep which are executed sequentially.

3. The automatic washing machine of claim 1 or 2, wherein said rinsing operation is executed after said washing operation is executed.

4. A method for controlling an automatic washing machine including a rotatable tub structure for receiving washing therein; an agitating vane provided within said tub structure; driving means for selectively driving said tub structure and said agitating vane; and control means, including a timer circuit for providing time information, and an information processor circuit for energizing said driving means in accordance with said time information from said timer circuit, for selectively driving said agitating vane and said tub structure to carry out a washing and rinsing operation respectively, said rinsing operation including at least one rinsing step; said method comprising the steps of:

examining water used in each rinsing step of said rinsing operation after each rinsing step is executed for a predetermined period of time to detect a degree of transparency of rinse water:

executing a first final overflow rinse for a predetermined period of time to complete said rinsing operation if the detected degree of transparency or rinse water of a rinsing step is at least equal to a predetermined value of transparency;

executing another rinsing step if the detected degree of transparency of rinse water of said rinsing step is less than a predetermined value of transparency;

executing a second final overflow rinse for a predetermined period of time to complete said rinsing operation if the detected degree of transparency of rinse water of said another rinsing step is at least equal to a predetermined value.

5. The method of claim 4 further comprising the step of executing a water drainage substep prior to said each rinsing step.

6. In an automatic washing machine having a rotatable tub, an agitating vane, and means for selectively driving said vane and said tub for respectively executing a washing and a rinsing operation, the improvement comprising:

means for sensing a transparency of rinse water;

means for comparing said sensed transparency with a predetermined reference value; and means for selecting a first type of rinsing step when said sensed transparency is at least equal to said reference value, and a second type of rinsing step when said sensed transparency is less than said reference value.

7. The automatic washing machine of claim 6, wherein said selecting means further selects a third type of rinsing step after a predetermined number of rinsing steps of said second type are selected.

8. The automatic washing machine of claim 7 wherein said first type of rinsing step is an overflow rinse for a short time;

said second type of rinsing step is an ordinary rinse; and said third type of rinsing step is an overflow rinse for a relatively longer time.

9. The automatic washing machine of claim 7 wherein:

said first type of rinsing step is an overflow rinse for a short time, and said second type and said third type of rinsing steps are overflow rinses for respective relatively longer times.

10. The automatic washing machine of claim 8 or 9 further comprising means for executing a drain and dehydration step preceding execution of a rinsing step of said second type.

11. The automatic washing machine of claim 10 further comprising means for executing respective drain and dehydration steps following execution of said first type and said third type of rinsing steps.

12. The automatic washing machine of claim 6 wherein said sensing means comprises a light emission diode for emitting light and a phototransistor for receiving said emitted light.

* * * * *